US006782729B2

(12) United States Patent
Sperrer

(10) Patent No.: US 6,782,729 B2
(45) Date of Patent: Aug. 31, 2004

(54) TOOL CLAMPING DEVICE FOR SHAPING TOOL, ESPECIALLY FOR A PRESS BRAKE

(75) Inventor: Gerhard Sperrer, Wartberg/Krems (AT)

(73) Assignee: Trumpf Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 10/365,338

(22) Filed: Feb. 12, 2003

(65) Prior Publication Data

US 2003/0221476 A1 Dec. 4, 2003

Related U.S. Application Data

(63) Continuation of application No. PCT/AT01/00254, filed on Jul. 25, 2001.

(30) Foreign Application Priority Data

Aug. 14, 2000 (AT) ..... 1399/2000

(51) Int. Cl.[7] ..... B21D 37/04; B21D 5/02
(52) U.S. Cl. ..... 72/481.6; 72/481.1
(58) Field of Search ..... 72/481.1, 481.6, 72/482.1, 482.2, 482.6, 482.93, 482.92

(56) References Cited

U.S. PATENT DOCUMENTS 4,534,203 A 8/1985 Cros
4,620,435 A 11/1986 Gabella et al.
5,022,256 A * 6/1991 van der Meulen ..... 72/482.91
5,065,610 A * 11/1991 Yonezawa ..... 72/462
5,245,854 A 9/1993 Bruggink et al.
5,782,308 A * 7/1998 Latten et al. ..... 72/481.6
6,003,360 A * 12/1999 Runk et al. ..... 72/482.2
6,564,611 B2 * 5/2003 Harrington et al. ..... 72/481.2
6,644,090 B2 * 11/2003 Gasparini ..... 72/482.2

FOREIGN PATENT DOCUMENTS

EP 0 934 782 A2 8/1999
GB 939.305 10/1963
JP 09108739 A 4/1997

* cited by examiner

*Primary Examiner*—David Jones
(74) *Attorney, Agent, or Firm*—Alston & Bird LLP

(57) ABSTRACT

A tool-clamping device for a forming tool, in particular a bending punch or bending die, on a compression beam, in particular an edging press, comprising a tool adapter attached to the compression beam and designed to releasably hold the forming tool. At least one resiliently elastic return means is provided between a receiving region of the tool adapter and a connecting region of the tool adapter or between the beam and the tool adapter to counteract a relative displacement between the tool adapter and forming tool and the compression beam in the longitudinal direction of the beam.

14 Claims, 4 Drawing Sheets

TOOL CLAMPING DEVICE FOR SHAPING TOOL, ESPECIALLY FOR A PRESS BRAKE

CROSS-REFERENCE TO RELATED APPLICATIONS

This application is a continuation of International Patent Application PCT/AT01/00254 filed Jul. 25, 2001, which designated inter alia the United States.

FIELD OF THE INVENTION

The invention relates to a tool-clamping device for clamping a forming tool, such as a bending punch, on a compression beam in a press such as an edging press, with a tool adapter attached to the compression beam to releasably hold the forming tool.

BACKGROUND OF THE INVENTION

In order to releasably hold forming tools, such as bending dies or bending punches for example, on a compression beam in a press, in particular in an edging press, a known approach is to provide tool adapters extending in the longitudinal direction of the compression beam and fixed thereto in a stationary arrangement, so that they form a groove-shaped holder for the tools. The tools are held in position in the holder by a clamping device. The tool adapter and the tools are designed as matching modules and a compression beam is fitted with the tool adapter by contact friction along a portion of the length of the compression beam.

The tool adapter of this known design is attached to a side face of the compression beam and, in order to transmit the compression force, has a compression piece which co-operates with the side face of the compression beam and is moved into abutment therewith. The disadvantage of this design is that the bending deformation of the compression beam and the tool adapters conforming to the bending line during a compression process cause an undefinable relative displacement in the direction of the longitudinal extension of the compression beam between the latter and the tool adapters as a result of the different radius of the neutral zone to the curvature mid-point. Under extreme circumstances, this can cause the tool adapter to migrate from a pre-defined position on the compression beam within a clearance dependent on tolerances. This relative shifting, which also occurs between the bottom and top tool, results in incorrectly processed workpieces and hence in more demanding control requirements and increased costs.

SUMMARY OF THE INVENTION

Accordingly, the objective of the invention is to propose a tool-clamping device designed so that the tool adapters are returned to the original position once the compression process producing the bend is terminated and the tool adapter changes position relative to the compression beam.

This objective is achieved by providing a tool-clamping device for affixing a forming tool on a compression beam in a press, comprising a tool adapter structured and arranged to releasably hold the forming tool, the tool adapter having a receiving region for receiving the forming tool and a connecting region structured and arranged to engage the compression beam, the tool adapter further comprising at least one resiliently elastic return means disposed between the forming tool and the compression beam, the return means being elastically deformed by relative displacement between the forming tool and the compression beam in a longitudinal direction of the beam as a result of deformation of the beam caused by force exerted on the beam during a compression process, the return means restoring the tool adapter to an initial position thereof when the force on the beam is removed.

In some advantageous embodiments, the return means is created by material splits formed in the tool adapter so as to form resilient connecting webs between the receiving region and the connecting region of the adapter. As a result, the receiving region of the tool adapter is able to effect compensating motions in the longitudinal direction of the compression beam relative to the connecting region in which the tool adapter is connected to the compression beam in a friction lock arrangement, and the friction-lock connection is not placed under strain from lateral forces as a result, so that the receiving region is automatically returned to the initial position on completion of the compression stroke.

Other advantageous embodiments include sliding or rolling elements between the opposing surfaces of the tool adapter and the compression beam such that the friction between the adapter and the compression beam is reduced and the resultant different longitudinal expansions during the bending action are compensated, enabling the tool adapter to be returned to the initial position.

In one embodiment the return means comprise resiliently elastic fixing elements such as screws that affix the tool adapter to the compression beam. The fixing elements provide the return forces needed to cause the tool adapter to be returned to its initial position.

In another possible embodiment the requisite return forces are achieved using structurally simple machine elements that do not incur any significant degree of effort in terms of assembly during manufacture of the system.

Finally, another embodiment is of advantage because it enables the lateral deflection and rebound behavior in the tool adapter to be selectively fixed between the receiving and the connecting region.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
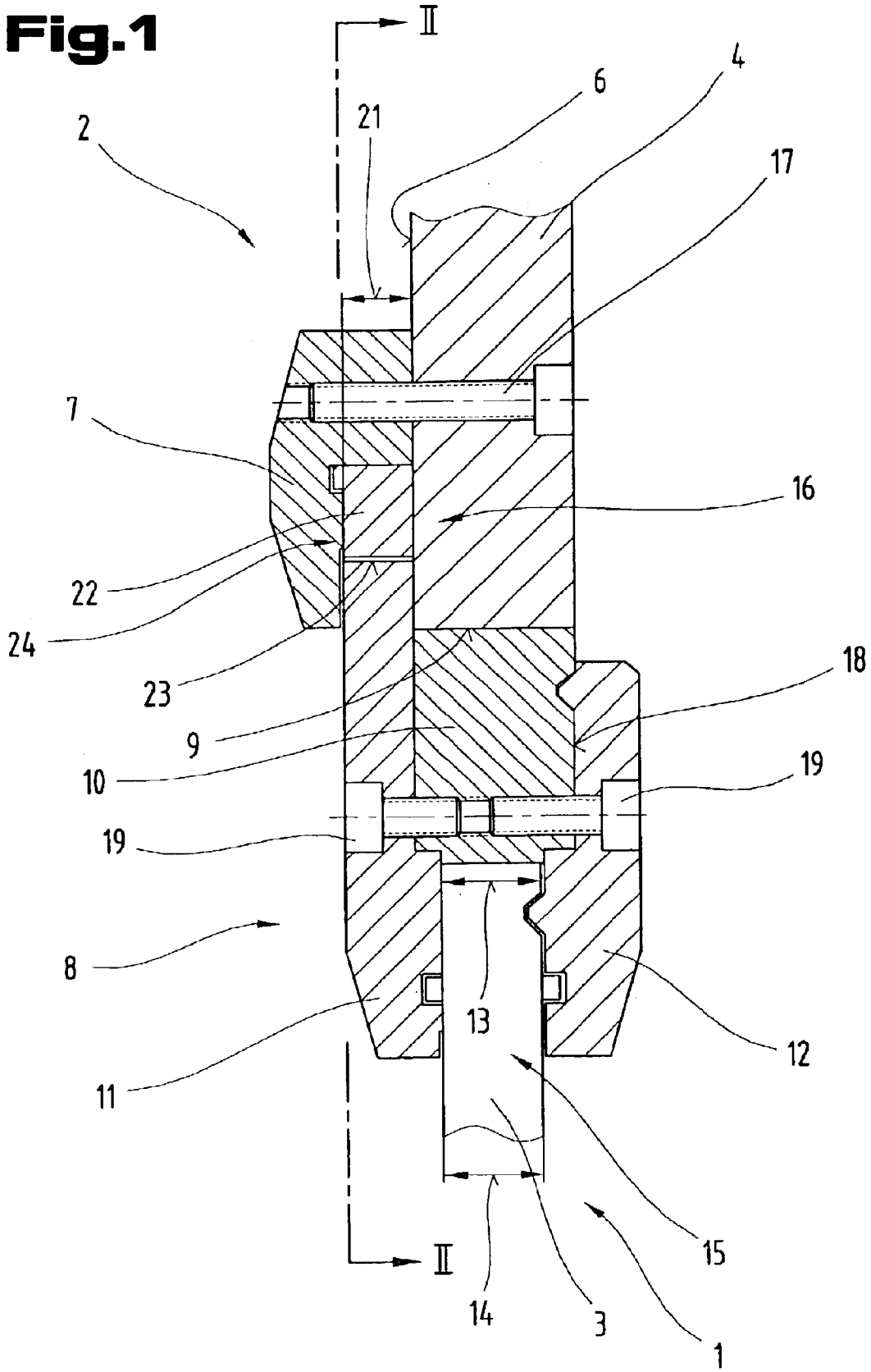
FIG. 1 is a side view in section, showing a part-region of a compression beam with a tool-clamping device as proposed by the invention.
Figure 2:
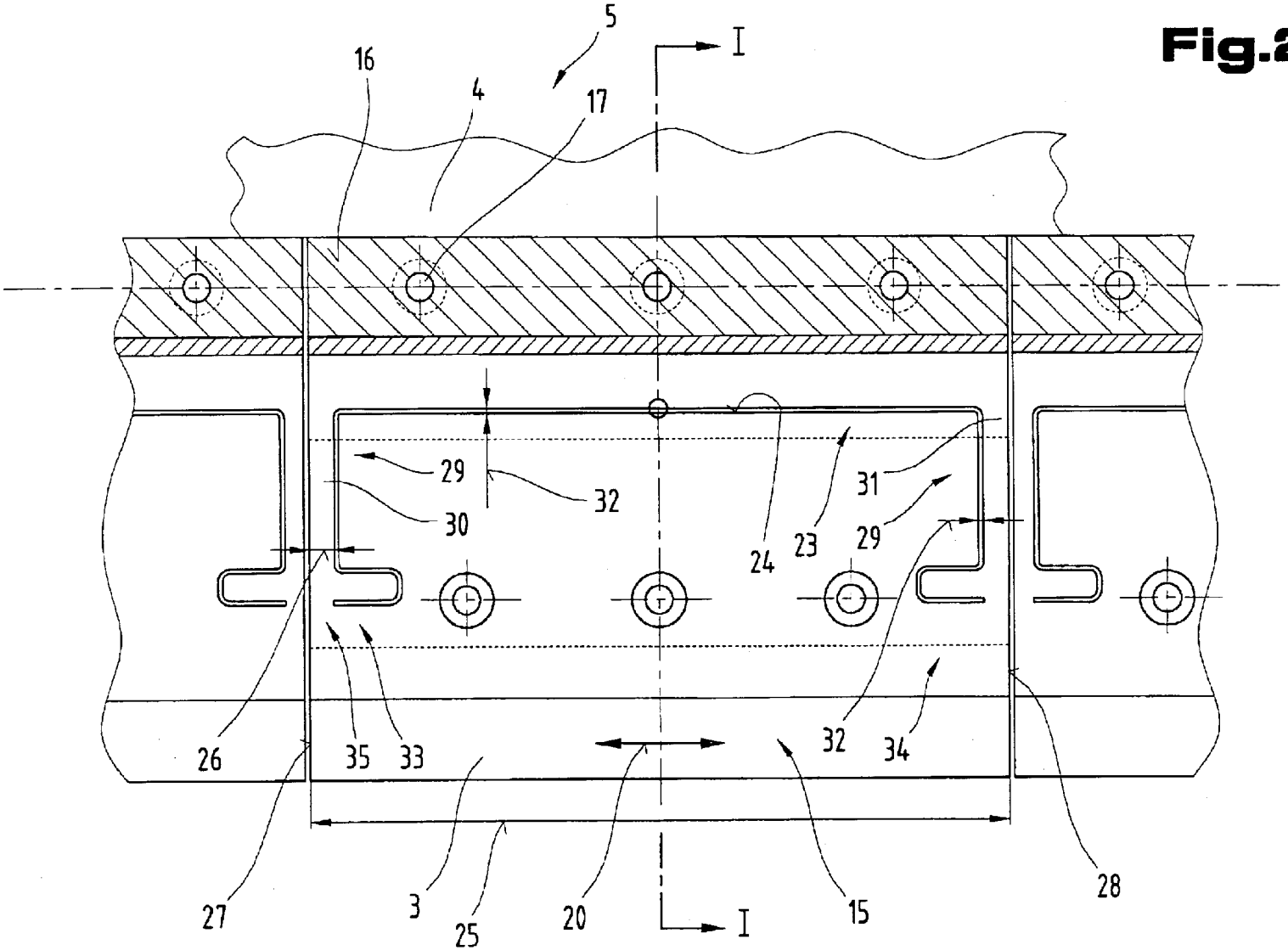
FIG. 2 is a section through the tool-clamping device proposed by the invention, along line II—II indicated in FIG. 1.

FIGS. 1 and 2 illustrate a tool holder 1 of a tool clamping device 2 for forming tools 3, e.g., bending punches or bending dies, on a compression beam 4, for an edging press 5, for example.

A tool adapter 8 held on a side face 6 of the compression beam 4 by means of a clamping block 7 which can be screwed to the compression beam 4 comprises a compression piece 10 supported against a compression surface 9 of the compression beam 4, with oppositely lying bar-shaped clamping jaws 11, 12 projecting out from the compression piece 10 and spaced apart from one another by a distance 13 corresponding to a thickness 14 of the forming tool 3, forming a groove-shaped receiving region 15 for the forming tool 3.

One of the clamping jaws 11, 12, which in the illustrated embodiment is the clamping jaw 11, projects out from the compression surface 9 in the direction of the compression beam 4 and overlaps with it at the side face 6, providing a connecting region 16 for a friction-locking abutment of the clamping jaw 11 and hence the tool adapter 8 in cooperation with the clamping block 7 for a number of fixing elements 17, e.g., screws, passing through the compression beam 4 in a thread engagement with the clamping block 7. The clamping jaw 12 lying on the other side of the compression piece 10 from clamping jaw 11, on the other hand, has a projecting arrangement only in the region of a side face 18 of the compression piece 10, the clamping screws 19 crossing through the clamping jaws 11, 12 and the compression piece 10 and being in a thread engagement with the compression piece 10, thereby releasably retaining the forming tool 3.

The tool adapter 8 is designed to enable an elastically reboundable relative displacement in the direction of the longitudinal extension of the compression beam 4, indicated by a double arrow 20 (FIG. 2), between the receiving region 15 and the connecting region 16. A split in the material 23 between these regions is provided for this purpose, extending across an entire thickness 21 of a clamping projection 22 and substantially parallel with the compression surface 9 of the compression beam 4, e.g. parting line 24, which extends in the direction of a length 25 of the tool adapter 8 and, at a lateral distance 26 from opposite terminal end faces 27, 28, merging with material splits 29 extending parallel with these terminal end faces 27, 28 in the direction of the tool holder 15. Accordingly, connecting webs 30, 31 are formed along the terminal end faces 27, 28, which, because of the elastic nature of the material of the tool adapter 8, form an elastically resilient bridge between the receiving region 15 and the connecting region 16. A possible relative displacement path in the direction of double arrow 20 between the receiving region 15 and the connecting region 16 therefore has a maximum dimension dictated by a parting width 32.

End regions 33, 34 of the material splits 29 extending along the terminal end faces 27, 28 directed towards the receiving region 15 may be of various designs that will impart the springing and rebound behavior of the connecting webs 30, 31. As a result of the elastically resilient properties of the material of the tool adapter 8, the connecting webs 30, 31 act as return means 34, 35, which provide compensation for the various differences in length that occur as a result of bending of the compression beam 3 during a working stroke and thus counteract associated shifting between the compression beam 3 and the tool adapter 8, effectively preventing the tool adapter 8 from migrating along the compression surface 9 as a result.

Figure 3:
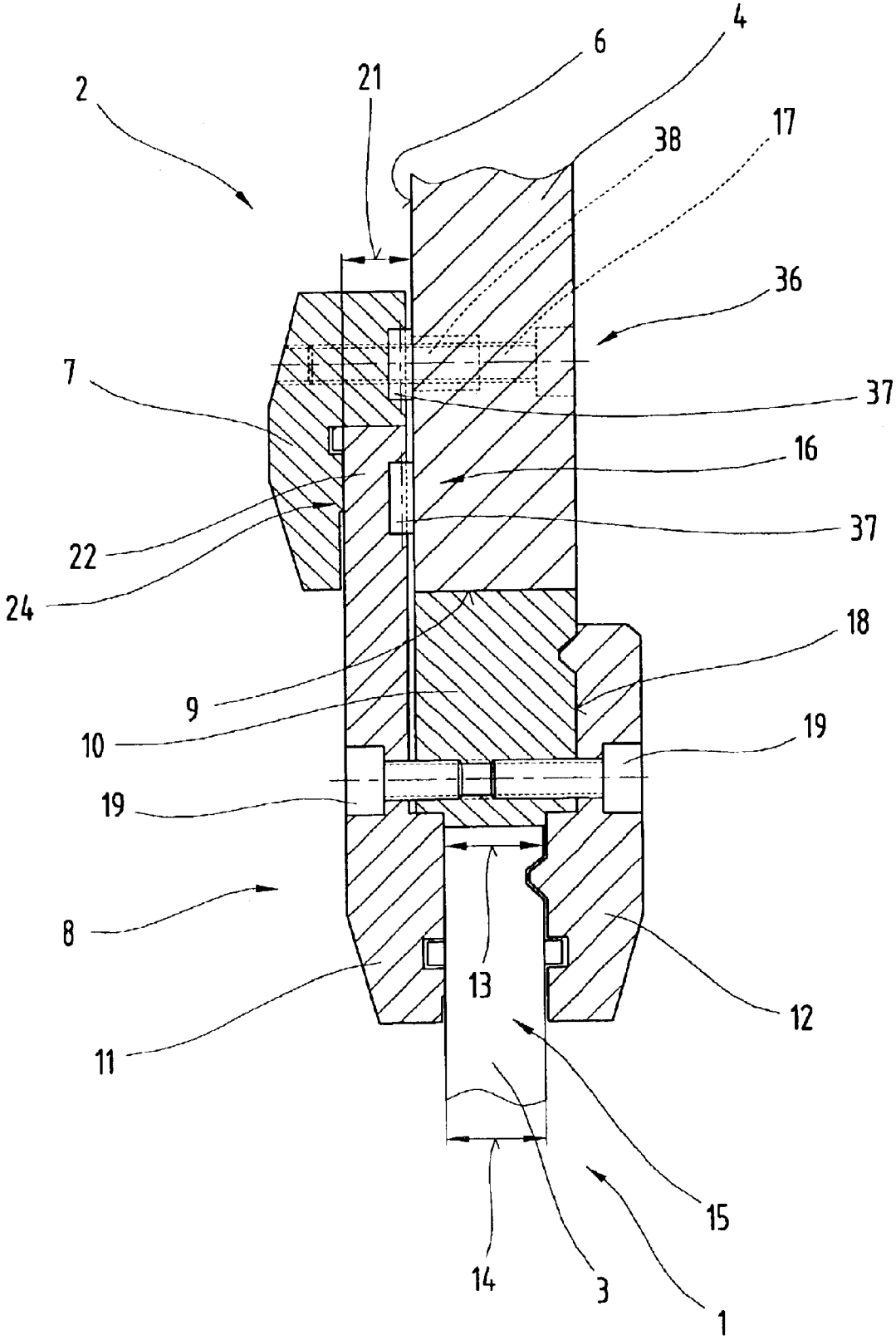
FIG. 3 is a side view in section, showing another embodiment of the tool-clamping device proposed by the invention.

FIG. 3 illustrates another embodiment of a tool adapter 8 fitted with a return element 36. In this embodiment, the return means 36 acts between the tool adapter 8 and the compression beam 4. The tool adapter 8 is essentially the same as that of the embodiment described with respect to the previous drawings, although it should be pointed out that with this design, when the tool adapter 8 is displaced on the compression beam 4 on completion of the compression stroke and hence the bending action, due to the different bending lines, the return means 36 returns the tool adapter 8 on the compression beam 4 to the original position. To this end, the tool adapter 8 and/or the compression beam 4 have a sliding or rolling means 37 which reduces the friction value in the connecting region. In the embodiment illustrated as an example, rolling elements are provided between the tool adapter 8 and the compression beam 4, which enable a relative displacement in the direction of the longitudinal extension of the compression beam 4. Similarly, a rolling element permitting such relative displacement is provided between the clamping block 7 and the compression beam 4. The fixing elements 17 that extend through the clamping block 7 and through the compression beam 4 to affix the clamping block to the tool adapter 8 act as return springs 38; the rolling element 37 is inserted in between the clamping block and the compression beam. The fixing elements 17 are bent during a relative displacement. Once the force causing the relative displacement disappears, the resilient elasticity of the fixing elements 17 causes a rebound to the original position, so that the tool adapter 8 is returned to the original position relative to the compression beam 4 and any continuous migration of the tool adapter 8 that would otherwise be associated with each individual work cycle is prevented.

Naturally, other means may also be used to reduce the friction value between the tool adapter 8, the clamping block 7, and the compression beam 4. For example, the surfaces which come into friction contact with one another in the connecting region 16 could be provided with a coating of synthetic materials, e.g., Teflon, which has a particularly low coefficient of friction.

Naturally, it would also be possible to use ball bearings in the connecting region 16 instead of the rolling elements.

Figure 4:
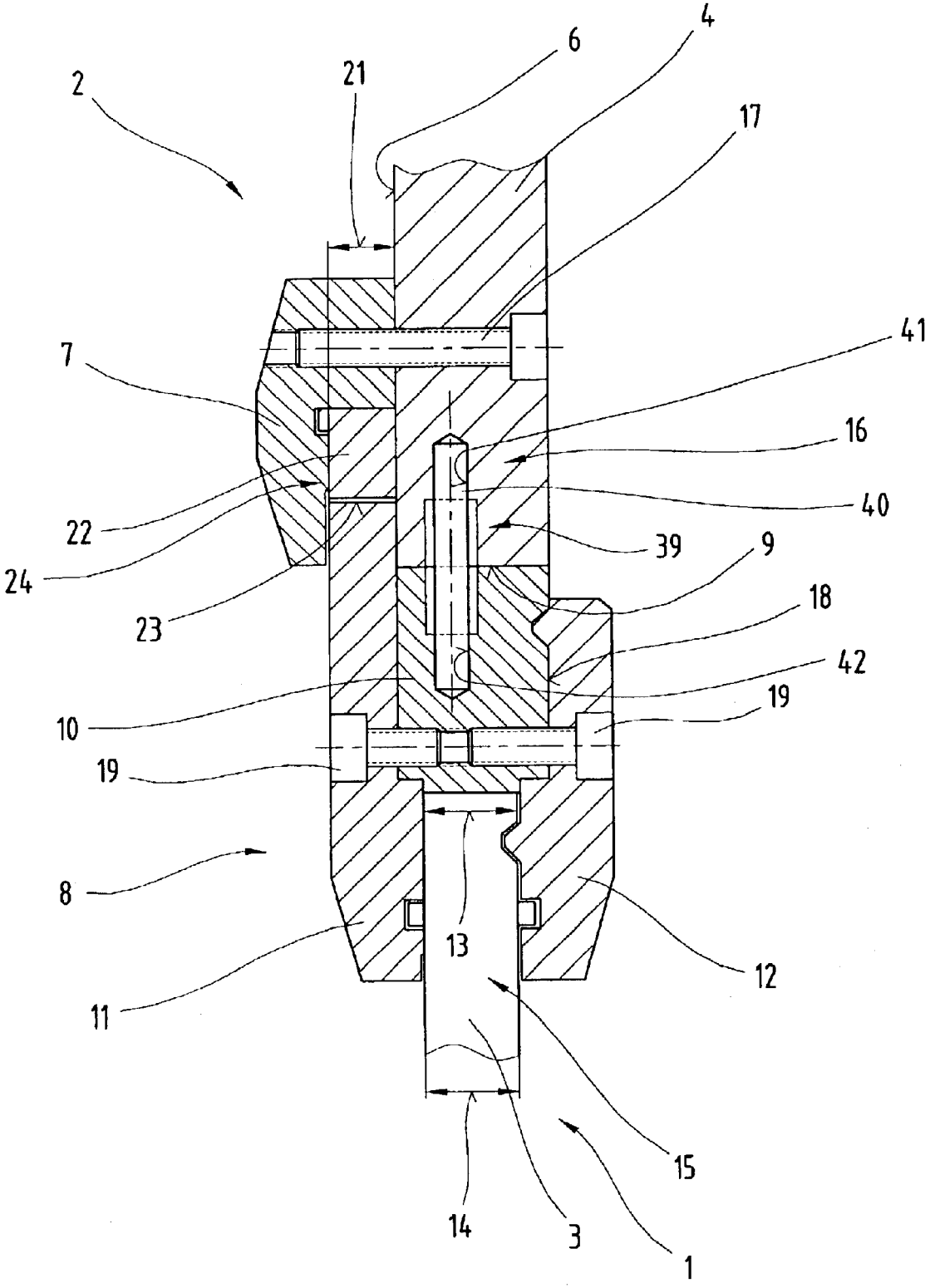
FIG. 4 is a side view in section, showing another embodiment of the tool-clamping device proposed by the invention.

FIG. 4 illustrates another embodiment of a return means 39 between the tool adapter 8 and the compression beam 4 for reversing a shifting motion occurring between the tool adapter 8 and the compression beam 4. In this embodiment, in which the tool adapter 8 is of the design described in respect of the previous drawings, the return means 39 are provided in the form of pins 40, in the form of flexion springs or rod springs, inserted between the compression beam 4 and the compression piece 10 perpendicular to the compression surface 9 of the compression beam 4, which undergo a bending deformation in the event of a relative displacement between the compression beam 4 and the compression piece 10 on exposure to a displacement force, and, once the displacement force has disappeared, the rebound causes a return to the original position. The compression beam 4 and the compression piece 10 have countersunk receiving bores 41, 42, causing the pins 40 to be released for a bending deformation.

However, it would also be possible to provide the return means 39 directly on the compression beam, allowing it to act directly on the forming tool 3, so that a relative displacement effected by the forming tool 3 due to bending deformation of the compression beam 4 is compensated and the forming tool 3 returned to its initial position.

For the sake of good order, it should finally be pointed out that in order to provide a clearer understanding of the tool holder 1, it and its constituent parts have been illustrated out of scale to a certain extent and/or on an enlarged and/or reduced scale.

The tasks underlying the independent inventive solutions can be found in the description.

Above all, subject matter relating to the individual embodiments illustrated in FIGS. 1, 2, 3, and 4 can be construed as independent solutions proposed by the invention. The tasks and solutions can be found in the detailed descriptions relating to these drawings.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tool-clamping device for affixing a forming tool on a compression beam in a press, comprising a tool adapter structured and arranged to releasably hold the forming tool, the tool adapter having a receiving region for receiving the forming tool and a connecting region structured and arranged to engage the compression beam, the tool adapter further comprising at least one resiliently elastic return means disposed between the forming tool and the compression beam, the return means being elastically deformed by relative displacement between the forming tool and the compression beam in a longitudinal direction of the beam as a result of deformation of the beam caused by force exerted on the beam during a compression process, the return means restoring the tool adapter to an initial position thereof when the force on the beam is removed.

2. The tool-clamping device as claimed in claim 1, wherein the return means comprises at least one resiliently elastic connecting web that connects the receiving region to the connecting region of the tool adapter.

3. The tool-clamping device as claimed in claim 2, wherein the at least one connecting web is integrally joined to the receiving region and the connecting region of the tool adapter and is created by a material split in the tool adapter.

4. The tool-clamping device as claimed in claim 2, wherein the tool adapter has two connecting webs respectively extending along opposite terminal end faces of the tool adapter and linking the receiving region to the connecting region.

5. The tool-clamping device as claimed in claim 4, wherein the material split that forms the connecting webs extends in a substantially U-shaped arrangement including a base portion extending adjacent to and substantially parallel with the connecting region and opposite legs that extend perpendicular to the base portion and substantially parallel with the opposite terminal end faces of the tool adapter.

6. The tool-clamping device as claimed in claim 5, wherein end regions of the material splits constituting the legs form parting lines extending at an angle to one another.

7. The tool-clamping device as claimed in claim 1, wherein the tool adapter further comprises a clamping block for holding the tool adapter on a side face of the compression beam.

8. The tool-clamping device as claimed in claim 7, wherein the tool adapter includes sliding or rolling means for reducing friction between the connecting region of the tool adapter and the compression beam.

9. The tool-clamping device as claimed in claim 8, wherein the tool adapter includes sliding or rolling means for reducing friction disposed between a clamping surface of the clamping block and the compression beam.

10. The tool-clamping device as claimed in claim 8, wherein the sliding or rolling means are provided in the form of a layer of synthetic material disposed between surfaces of the tool adapter and the compression beam that come into frictional contact.

11. The tool-clamping device as claimed in claim 9, wherein the sliding or rolling means are provided in the form of rolling elements disposed between the connecting region and the compression beam and between the clamping surface and the connecting beam.

12. The tool-clamping device as claimed in claim 1, wherein the resiliently elastic return means comprise clamping screws that affix the tool adapter to the compression beam.

13. The tool-clamping device as claimed in claim 1, wherein the return means comprise pins between the tool adapter and the compression beam, the pins acting as rod springs.

14. The tool-clamping device as claimed in claim 1, wherein the return means comprise a web link between the receiving region and the connecting region in the form of material splits meandering in the longitudinal direction of the compression beam.

* * * * *